US006196190B1

(12) United States Patent
Przymusinski et al.

(10) Patent No.: US 6,196,190 B1
(45) Date of Patent: Mar. 6, 2001

(54) METHOD FOR DETERMINING AN OPERATING PARAMETER FOR STARTING AN INTERNAL COMBUSTION ENGINE

(75) Inventors: Achim Przymusinski, Regensburg; Andreas Hartke, München; Dirk Heinitz, Schönhofen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/524,231

(22) Filed: Mar. 13, 2000

Related U.S. Application Data

(63) Continuation of application No. PCT/DE98/02656, filed on Sep. 8, 1998.

(51) Int. Cl.[7] ..... F02D 41/06

(52) U.S. Cl. ..... 123/352; 123/179.16; 123/491

(58) Field of Search ..... 123/339.1, 339.19, 123/179.16, 350, 352, 357, 491

(56) References Cited

U.S. PATENT DOCUMENTS 4,459,670 * 7/1984 Yamaguchi et al. ..... 123/491 X
4,501,248 * 2/1985 Eisele et al. ..... 123/478
4,964,386 10/1990 Akiyama et al. ..... 123/339.21
5,199,400 * 4/1993 Sprenger et al. ..... 123/339.24

FOREIGN PATENT DOCUMENTS

0206272A2 12/1986 (EP) .
2146800A 4/1985 (GB) .
3-23329 * 1/1991 (JP) .

* cited by examiner

*Primary Examiner*—Tony M. Argenbright
(74) *Attorney, Agent, or Firm*—Herbert L. Lerner; Laurence A. Greenberg; Werner H. Stemer

(57) ABSTRACT

A method of starting an internal combustion engine having an injection system and characteristic variables includes the steps of supplying an injection system with an operating parameter that is determined from characteristic variables, supplying a speed regulator with an initialization value as an initial starting variable, and regulating a speed of an internal combustion engine up to an idling speed with the speed regulator based upon the initialization value. The acceleration to idling speed is carried out with the aid of the speed regulator based on the initialization value. The injection system is supplied with a mass of fuel to be injected. Regulation is carried out with a speed regulator already present in an engine controller. The initialization value is stored in a characteristic curve as a function of coolant temperature. The initialization value is applied to a first injection operation of the internal combustion engine.

5 Claims, 2 Drawing Sheets

METHOD FOR DETERMINING AN OPERATING PARAMETER FOR STARTING AN INTERNAL COMBUSTION ENGINE

CROSS-REFERENCE TO RELATED APPLICATION

This is a continuation of copending international application PCT/DE98/02656, filed Sep. 8, 1998, which designated the United States.

BACKGROUND OF THE INVENTION

1. Field of the Invention

The invention lies in the field of internal combustion engines. The invention relates to a method of determining an operating parameter for starting an internal combustion engine, in particular, for determining the mass of fuel to be injected.

An internal combustion engine can be started without any special regulation if the starting operation is carried out with the aid of a starting function. The starting function uses the operating parameters as a basis to calculate one or more parameters for the injection system, with which parameters the internal combustion engine is then started. The operating parameters include, for example, the coolant temperature and the rotational speed from a number of characteristic maps. A change is made to speed regulation once a specific idling speed has been reached. DifficuLties arise from the fact that the same starting behavior is intended to be achieved with very different operating parameters.

A starting operation using a predefined starting function is illustrated in FIG. 3. In accordance with the predefined starting function, between time t1 and time t2, a mass m of fuel is injected as soon as the rotational speed of the internal combustion engine has reached the speed $N_{ST}$ using the starter. From time t2, the speed regulator takes over the regulation of the internal combustion engine. The predefined starting function, however, leads to severe overrunning of the speed N during the starting operation until the idling speed N_SP is finally reached. In order to avoid overrunning and to obtain reproducibility of the starting operations when the starting function is being predefined, it is necessary for all cross-influences in the starting function to be taken into account because the function involves open-loop control.

A computer-controlled injection system for diesel engines is disclosed in German Patent No. 30 09 627 C2. The injection system controls the starting valves at the beginning of the starting operation, and the triggering angle for the injection operation is calculated based on the crankshaft angle using a special program.

SUMMARY OF THE INVENTION

It is accordingly an object of the invention to provide a method of determining an operating parameter for starting an internal combustion engine that overcomes the herein aforementioned disadvantages of the heretofore-known devices and methods of this general type and that improves the starting behavior of an internal combustion engine.

With the foregoing and other objects in view, there is provided, in accordance with the invention, a method of starting an internal combustion engine having an inject:ion system and characteristic variables including the steps of supplying an injection system with an operating parameter determined from characteristic variables, supplying a speed regulator with an initialization value as an initial starting variable, and regulating a speed of an internal combustion engine up to an idling speed with the speed regulator based upon the initialization value.

According to the invention, a regulator carries out the starting operation. In particular, the regulator is the speed or idling speed regulator that is typically present. The regulator is initialized with a parameter, in particular, the mass of fuel, for the starting operation. The parameter, which is supplied to the regulator at the beginning of the starting operation, depends on various operating parameters of the internal combustion engine, and is stored in a characteristic curve in an internal combustion engine controller as a function of the coolant temperature. After the initialization has been predefined, the acceleration of the internal combustion engine to the idling speed is then carried out using the regulator. Using the method of the invention results in a better starting behavior, and the problem of the transient response to the idling speed, typically arising when the starting function is used, does not occur. A particular advantage resides in the fact that the starting operation is carried out using a speed regulator that is usually present in the controller and is, therefore given an expanded range of applications.

In accordance with another mode of the invention, the first supplying step is performed by supplying the injection system with a mass of fuel to be injected.

In accordance with a further mode of the invention, the second supplying step is performed by carrying out regulation with a speed regulator present in an engine controller.

In accordance with an added mode of the invention, there is provided the step of reading the initialization value from a characteristic curve containing the initialization as a unction of coolant temperature.

In accordance with a concomitant feature of the invention, there is provided the step of applying the initialization value to a first injection operation of the internal combustion engine.

Other features that are considered as characteristic for the invention are set forth in the appended claims.

Although the invention is illustrated and described herein as embodied in a method of determining an operating parameter for starting an internal combustion engine, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
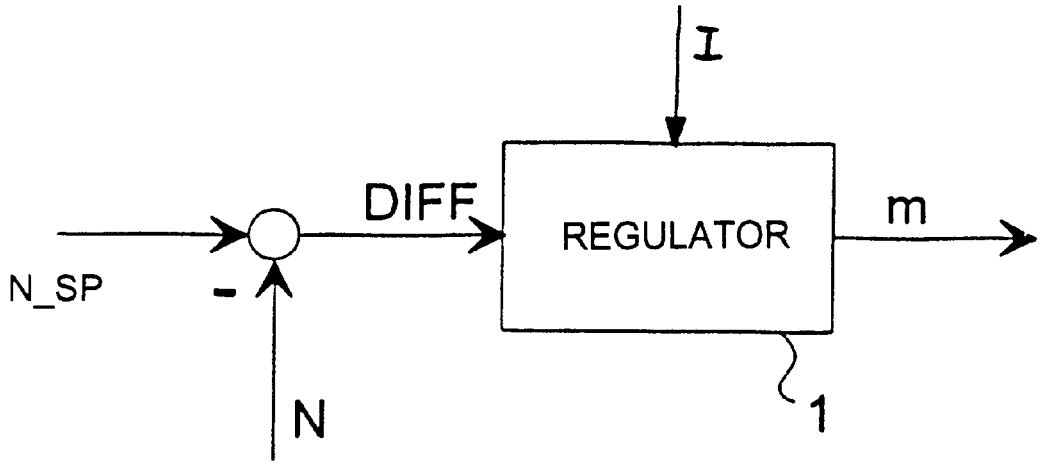
FIG. 1 is a block diagram of a speed regulator according to the invention.

In all the figures of the drawing, sub-features and integral parts that correspond to one another bear the same reference symbol in each case.

Referring now to the figures of the drawings in detail and first, particularly to FIG. 1 thereof, there is shown a speed regulator 1 that calculates a mass m of fuel (manipulated variable) from a difference DIFF between a speed set point N_SP and the actual speed N. The output signal from the regulator 1 is used to drive a non-illustrated injection valve of an internal combustion engine.

For starting, the regulator 1 is initialized with a mass I of fuel. The parameter I is preferably taken from a characteristic curve as a function of the coolant temperature. The parameter I determines the mass of fuel for the first injection that is carried out at the beginning of the starting operation.

Figure 2:
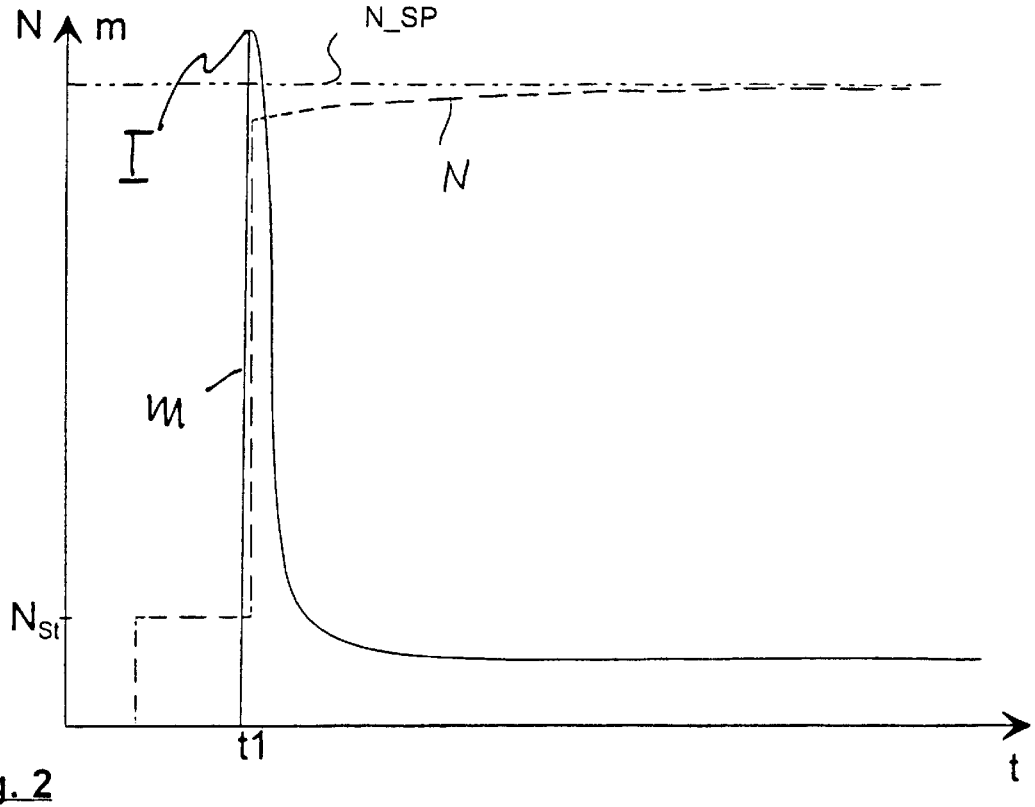
FIG. 2 is graph showing a variation of an injected mass of fuel and a rotational speed in accordance with the method of the invention.
Figure 3:
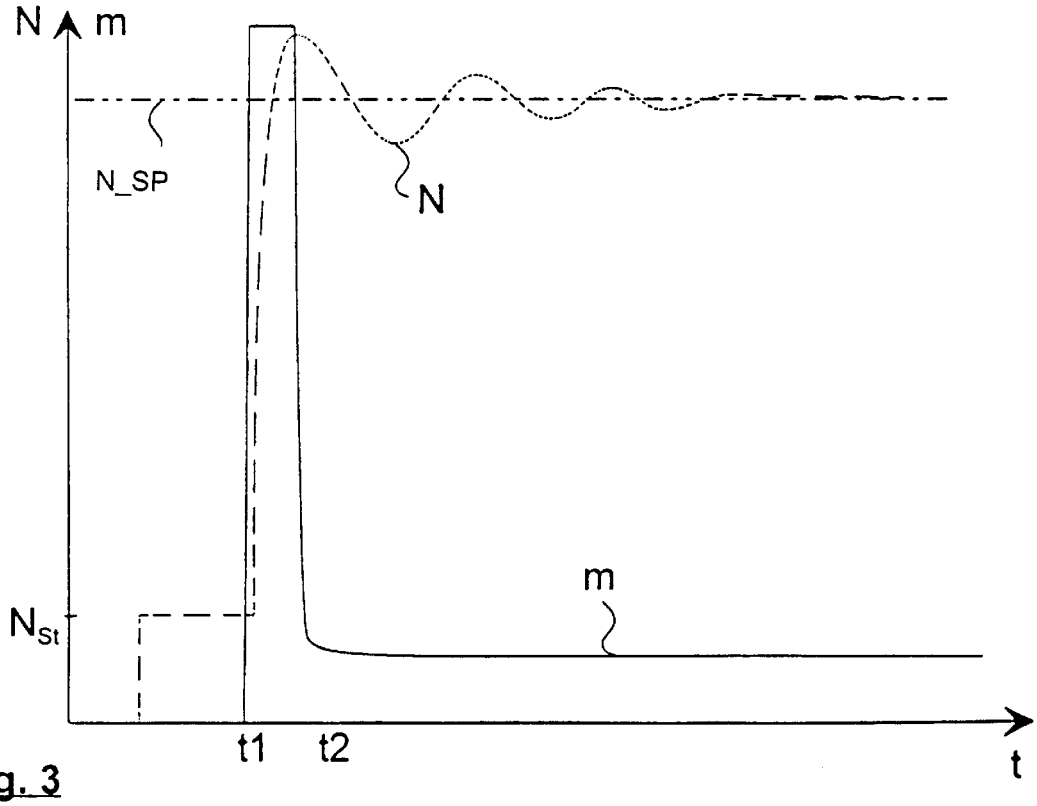
FIG. 3 is a graph showing a variation of an injected mass of fuel and a rotational speed when a starting function is predefined.

FIG. 2 shows the variation over time of the injected mass m of fuel. Once a specific starter speed NST has been reached, the first injection predetermined by the initialization I is carried out and the curve m rises steeply. Based upon the initialization value I, the regulator 1 calculates the mass of fuel to be injected so that the rotational speed N approaches the set point N_SP without allowing the transient processes illustrated in FIG. 3 to occur. According to FIG. 2, the regulation results in an improved and reproducible starting behavior. The noise behavior and the exhaust-gas emission during the starting operation are also improved. Through a simple predefinition of the initialization value I for the speed regulator, it is, therefore, possible, to significantly reduce the computer outlay for the starting operation.

We claim:

1. A method of starting an internal combustion engine having an injection system and characteristic variables, which comprises:

supplying an injection system with an operating parameter determined from characteristic variables;

supplying a speed regulator with an initialization value as an initial starting variable; and regulating a speed of an internal combustion engine up to an idling speed with the speed regulator based upon the initialization value.

2. The method according to claim 1, wherein the first supplying step comprises supplying the injection system with a mass of fuel to be injected.

3. The method according to claim 1, wherein the second supplying step comprises carrying out regulation with a speed regulator present in an engine controller.

4. The method according to claim 1, which comprises reading the initialization value from a characteristic curve containing the initialization value as a function of coolant temperature.

5. The method according to claim 1, which comprises applying the initialization value to a first injection operation of the internal combustion engine.

* * * * *